US007036692B2

(12) United States Patent
Krohn

(10) Patent No.: US 7,036,692 B2
(45) Date of Patent: May 2, 2006

(54) DISPENSER WITH AN INTEGRALLY MOLDED NECK FINISH

(75) Inventor: Roy N. Krohn, Wrightsville, PA (US)

(73) Assignee: Graham Packaging Company, L.P., York, PA (US)

( * ) Notice: Subject to any disclaimer, the term of this patent is extended or adjusted under 35 U.S.C. 154(b) by 43 days.

(21) Appl. No.: 10/368,524

(22) Filed: Feb. 19, 2003

(65) Prior Publication Data

US 2004/0159680 A1 Aug. 19, 2004

(51) Int. Cl.
*B67D 3/00* (2006.01)

(52) U.S. Cl. ..... 222/521; 222/539

(58) Field of Classification Search ..... 222/519–521, 222/522, 525, 549, 552, 562, 563, 539
See application file for complete search history.

(56) References Cited

U.S. PATENT DOCUMENTS

| | | | | |
|---|---|---|---|---|
| 2,628,909 | A | | 2/1953 | Horan |
| 2,758,755 | A | | 8/1956 | Schafler |
| 3,120,909 | A | * | 2/1964 | Miller ..... 222/522 |
| 3,197,532 | A | | 7/1965 | Maass |
| 3,326,421 | A | | 6/1967 | Peace |
| 3,599,845 | A | | 8/1971 | Miller |
| 4,082,827 | A | | 4/1978 | Chlystun |
| 4,171,749 | A | | 10/1979 | Obrist et al. |
| 4,529,108 | A | | 7/1985 | Chlystun |
| 4,540,542 | A | | 9/1985 | Weiler |
| 4,619,797 | A | | 10/1986 | Chlystun |
| 4,806,021 | A | | 2/1989 | Koudstaal et al. |
| 5,018,646 | A | | 5/1991 | Billman et al. |
| 5,141,136 | A | | 8/1992 | Tignor |
| 5,213,235 | A | | 5/1993 | Miranda |
| 5,226,551 | A | | 7/1993 | Robbins |
| 5,305,932 | A | * | 4/1994 | Iseli ..... 222/521 |
| 5,350,240 | A | | 9/1994 | Billman et al. |
| 5,505,346 | A | * | 4/1996 | Smith ..... 222/505 |
| 5,632,951 | A | | 5/1997 | Smith et al. |
| 5,782,344 | A | | 7/1998 | Edwards et al. |
| 5,860,743 | A | | 1/1999 | Larkin et al. |
| 5,884,758 | A | | 3/1999 | Sigouin et al. |
| 5,908,124 | A | | 6/1999 | Klauke et al. |
| 5,937,617 | A | | 8/1999 | Yeager |
| 5,941,642 | A | | 8/1999 | Darmstadter |
| 5,944,234 | A | | 8/1999 | Lampe et al. |
| 5,996,824 | A | | 12/1999 | Grant et al. |
| 6,290,094 | B1 | | 9/2001 | Arnold et al. |
| 6,631,832 | B1 | | 10/2003 | Wan et al. |

FOREIGN PATENT DOCUMENTS

| | | |
|---|---|---|
| WO | WO 02/38360 | 5/2002 |

* cited by examiner

*Primary Examiner*—Philippe Derakshani
(74) *Attorney, Agent, or Firm*—Venable LLP; James R. Burdett; Keith G. Haddaway

(57) ABSTRACT

A dispenser. The dispenser comprises a radially surrounding sidewall having a first end, where the sidewall is molded as one piece. The first end of the sidewall comprises a neck finish, where the neck finish comprises an opening and a protrusion adapted for sealingly engaging a corresponding opening of a cap.

19 Claims, 6 Drawing Sheets

DISPENSER WITH AN INTEGRALLY MOLDED NECK FINISH

FIELD OF THE INVENTION

The present invention relates to a dispenser with an integrally molded neck finish.

BACKGROUND OF THE INVENTION

Conventionally, flexible dispensers of consumer products such as cosmetics, hair gels, condiments, beverages and liquid soaps are often produced with large standing caps and/or with multi-unit closure pieces. Multi-unit closure pieces have utilized a post-and-hole type mechanism. In these closures, closing of a hole in the cap is accomplished by insertion of a post on a base piece that attaches to the bottle. However, the manufacture of multi-unit closure pieces as well as large standing caps is relatively costly. For consumer products with high retail prices, the same methods can be satisfactory when the dispenser costs only a small fraction of the overall price of the packaged product. However, for many other products such as cosmetics, hair gels, condiments, beverages, and liquid soaps, or for packages containing small amounts of product, where dispenser costs become relatively significant, there is an increasing demand to reduce dispenser costs. What is needed then is an improved dispenser and closure that overcomes the shortcomings of prior dispensers.

SUMMARY OF THE INVENTION

Above shortcomings are overcome by a dispenser according to the present invention. The dispenser comprises a radially surrounding sidewall having a first end, where the sidewall is molded as one piece. The first end of the sidewall comprises a neck finish, where the neck finish comprises at least one opening and a protrusion adapted for sealingly engaging a corresponding opening of a cap.

BRIEF DESCRIPTION OF THE DRAWINGS

The foregoing description of the invention will be apparent from the following, more particular description of an embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without departing from the spirit and scope of the invention.

Figure 1:
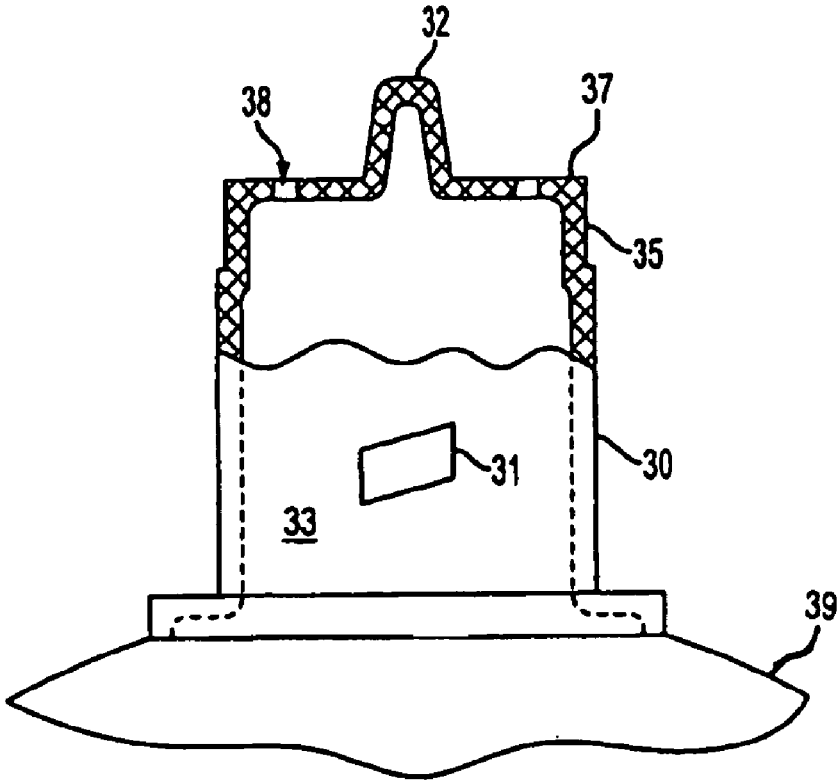
FIG. 1 depicts a close-up view of an embodiment of a neck finish according to the invention adapted for twist closure with a cap.

FIG. 1 depicts a close-up view of an embodiment of a neck finish 30 according to the invention adapted for twist-closure with a cap. The neck finish 30 can be integrally molded as one piece and can be substantially cylindrical. A ramp 31 is formed on the outer surface of a sidewall 33 of the neck finish for engagement with a thread of the cap so that as the cap turns, the thread turns and climbs up or down the ramp 31. The ramp can be located anywhere on the sidewall of the neck finish 30, including a location near the bottom of the neck finish 30. The neck finish 30 has a protrusion 32 in an end wall 37 of the neck finish 30 which sealingly engages a complementary dispensing opening of the cap when the cap is turned in a direction to ramp down to its closed position. At least one opening 38 can be created in the end wall 37 of the neck finish 30 to allow passage of a product therethrough. The end wall 37 can be located at the end of the neck finish 30 that is opposite the sidewall 39 of an article or dispenser to which it is attached. A leakage prevention contact surface 35 can be formed on the outer surface of the upper or lower portion of the sidewall of the neck finish so as to sealingly engage a complementary sealing surface on an inner surface of the cap. The leakage preventing contact surface 35 can be of sufficient height to maintain the sealing throughout the complete rotation of the cap up and down the neck finish 30. Such sealing prevents any leakage of products via the cap other than via the cap opening 40.

The opening 38 can be created by various methods. For example, the opening can be formed by first molding a protrusion over an opening in the neck finish at the time the neck finish 30 is molded. The protrusion is trimmed subsequently to create the opening 38 to allow an open passage of the enclosed product therethrough when the cap is pulled to its open position. Alternatively, the opening 38 can be created by reaming an opening into neck finish with a closed end wall. Still another exemplary method of creating the opening 38 is by using the opening 38 in a blow molded container as a blow hole or needle insertion point to blow-mold the rest of the neck finish. In any of these embodiments, the opening 38 can be reamed subsequently to form a smooth finish.

The neck finish can be integrally formed on an intermediate article according to the invention, where the intermediate article can be any suitable plastic dispenser. The plastic article can be made of any suitable plastic material, such as thermoplastic materials including nylon; polyolefins such as polyethylene or polypropylene; polyesters such as polyethylene terephthalate; and polycarbonates. Plastic articles integrated with the neck finish 30 can be formed by any suitable method known in the art including, but not limited to extrusion, extrusion blow molding, stretch blow molding, injection molding and injection blow molding.

Exemplary dimensions of the neck finish 30 are as follows. The height of the neck finish 30 to the end of the protrusion 32 can be about 8–40 mm, including 18.3 mm. A diameter of the neck finish 30 can be about 6–30 mm, including 13.1 mm. A diameter of the opening 38 can be about 0.4–2.0 mm, including 0.9 mm. These dimensions are exemplary only and can be adjusted to any value as necessary for desired applications.

Figure 2:
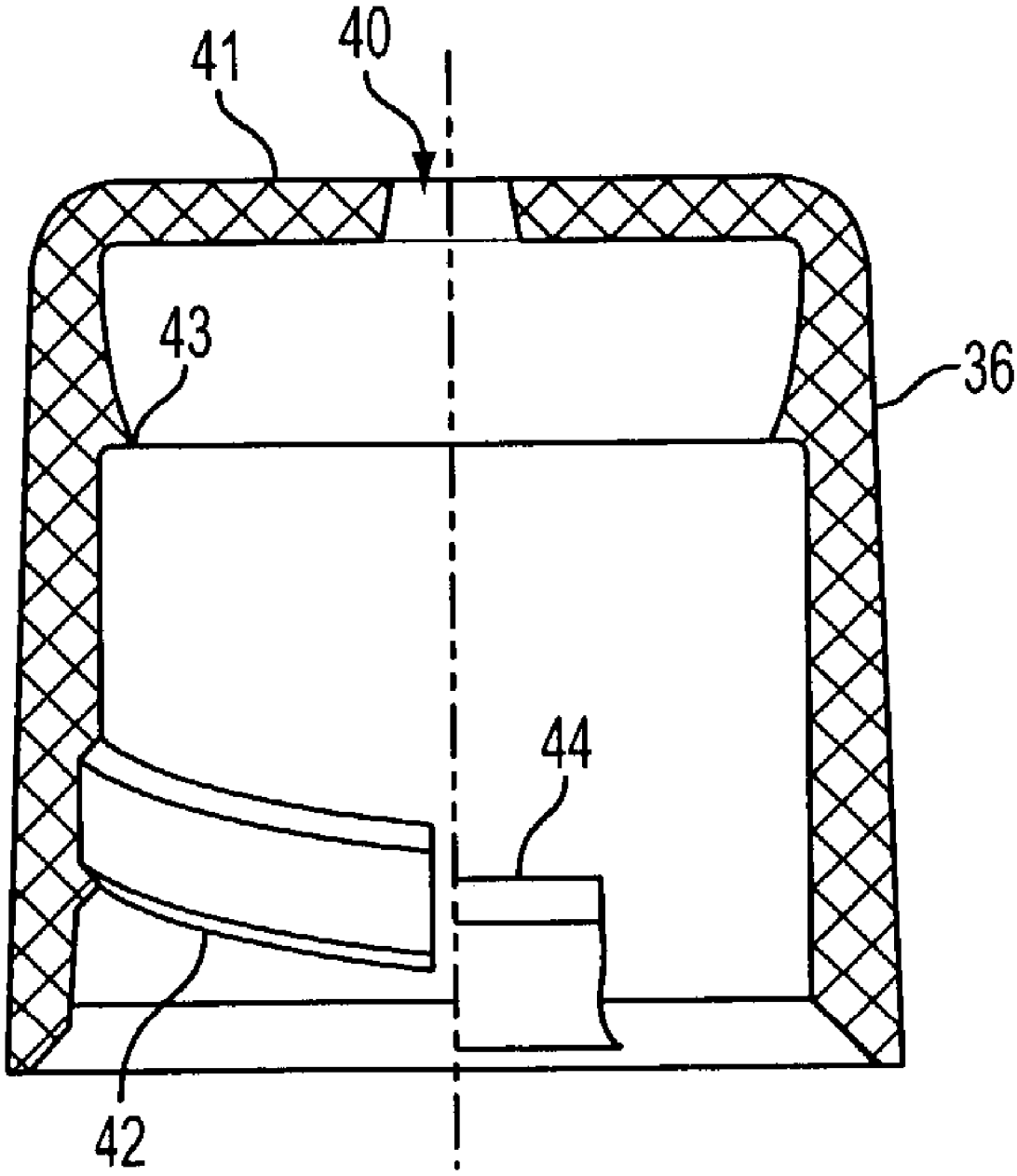
FIG. 2 depicts a close-up view of an embodiment of a cap according to the invention adapted for use with the neck finish in FIG. 1.

FIG. 2 depicts a close-up view of an embodiment of the cap 36 according to the invention. The neck finish 30 according to an embodiment of the invention can be used with any complementary cap, including the one shown in FIG. 2. The cap 36 can have a dispensing opening 40 located on the top 41 for dispensing the product when the cap is in the open position. The opening 40 can be of any shape including a round shape. A top 41 can be any structure including a flat, spherical, square, rectangular or triangular structure. The top 41 can also be a radial ramp formed around the opening 40. The radial ramp can have a linear slope or a curved, non-linear slope that can be concave or convex. In the exemplary embodiment of FIG. 2, a thread 42 is formed on an inner surface of a sidewall of the cap 36 to move the cap up or down as the thread of the cap slides up or down the ramp of the neck finish, respectively. The thread 42 can be of any length to allow an appropriate turn of the cap around the neck finish. An edge of a beveled annular bead 43 of the cap 36 can form a complementary sealing to prevent leakage when contacting the surface 35 of the neck finish. A rotation stop 44 can be formed on the inner surface of the cap 36 to prevent the cap from rotating beyond a certain limit such as one or more turns or a fractional turn, e.g., ¼, ⅓, ½ turn.

Exemplary dimensions of the cap 36 are as follows. The height of the cap 36 can be about 8–40 mm, including 17.1 mm. A diameter of the cap 36 can be about 8–40 mm, including 17.1 mm. A diameter of the opening 40 can be about 1.0–5.0 mm, including 2.3 mm. These dimensions are exemplary only and can be adjusted to any value as necessary for desired applications.

Figure 3:
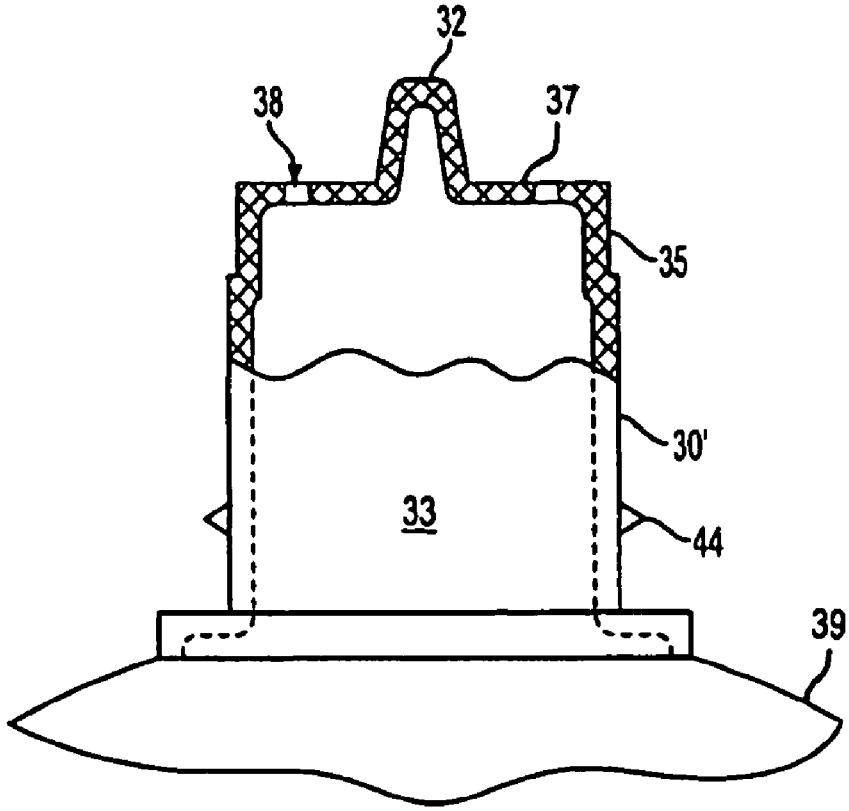
FIG. 3 depicts a close-up view of a cross-section of another embodiment of a neck finish according to the invention.

FIG. 3 depicts another embodiment of a neck finish 30' according to the invention. The neck finish 30' of this embodiment differs from the neck finish embodiment discussed in relation to FIG. 1 only in the portion where it attaches to the cap by having a push-pull fit rather than a threaded fit. The neck ring 44 is adapted for locking with a corresponding cap ring of a push-pull cap in order to prevent the cap from being taken off the neck finish. The neck ring 44 can be formed integrally as a one-piece unit with the neck finish 30' by using the same methods used for creating the neck finish 30 in FIG. 1. This embodiment does not require a ramp of the neck finish in FIG. 1 since the open-close mechanism is based on a push-pull mechanism.

Figure 4:
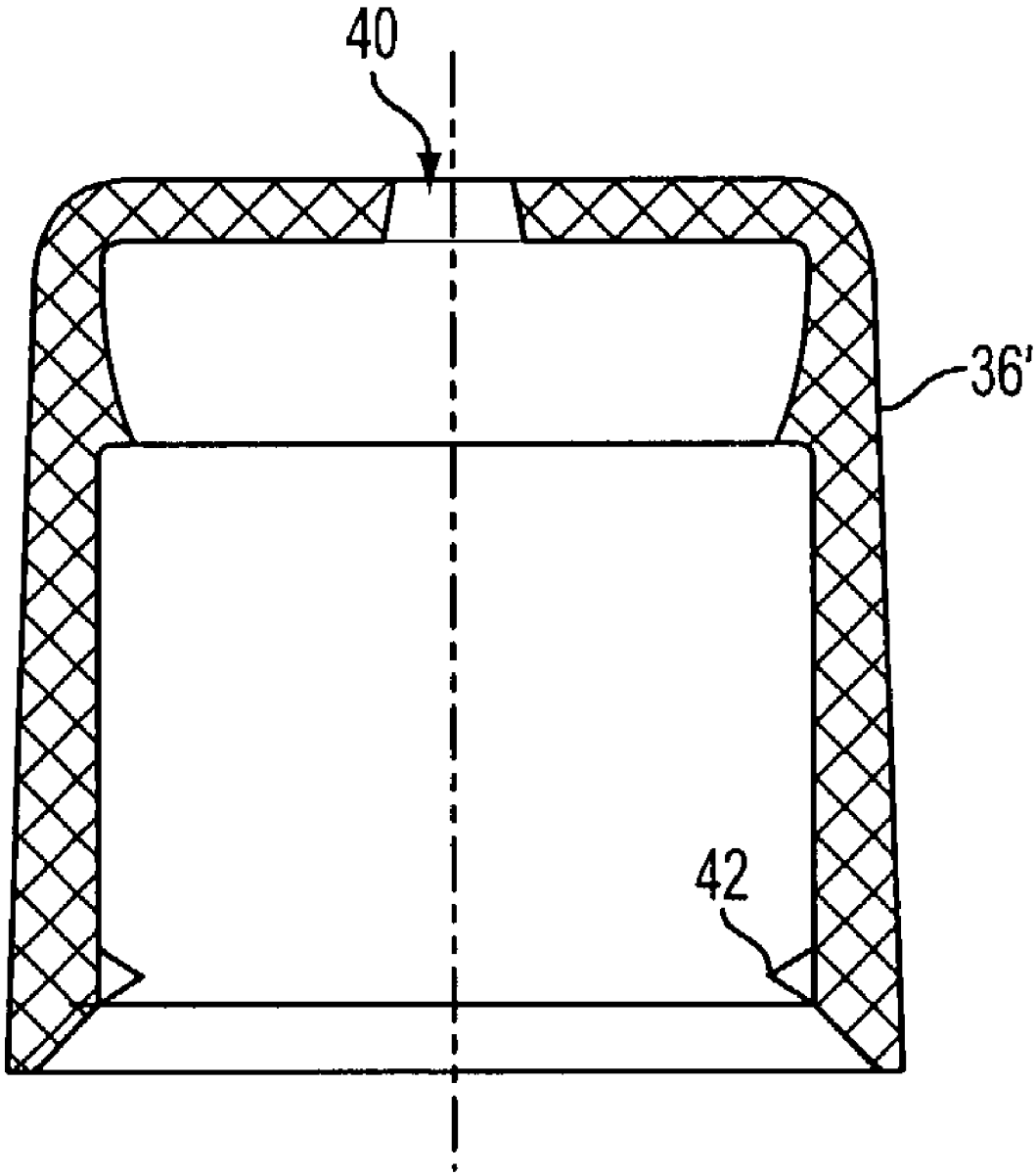
FIG. 4 depicts a close-up view of another embodiment of a cap adapted for use with the neck finish in FIG. 3.

FIG. 4 depicts a close-up view of an embodiment of a cap 36' adapted for use with the neck finish 30' in FIG. 3. The cap 36' differs from the cap embodiment discussed in relation to FIG. 1 only in that the cap 36' does not require the thread in FIG. 1 and has a cap ring 42. The cap ring 42 locks with the neck ring 44 of the neck finish in FIG. 3. The cap 36' operates with the neck finish 30' to form a resealable closure. The cap is pushed into a closed position wherein the post 32 is sealingly engaged within the opening 40. The opening 40 can be of any shape, including a circular, triangular, rectangular or an oval shape. The shape of the protrusion 32 of the neck finish varies also to accommodate a particularly selected shape of the opening 40. To open the dispenser, the cap 36' is pulled up to remove the post from the opening 40, allowing the product within the dispenser to flow out of the openings 38 of the neck finish, through a hollow space in the cap 36' and out the cap opening 40.

In the embodiments of the neck finish and the cap described above and below, only one protrusion of the neck finish and one corresponding opening of the cap have been depicted. However, the neck finish and the cap can have more than one set of a protrusion and a cap opening.

Figure 5:
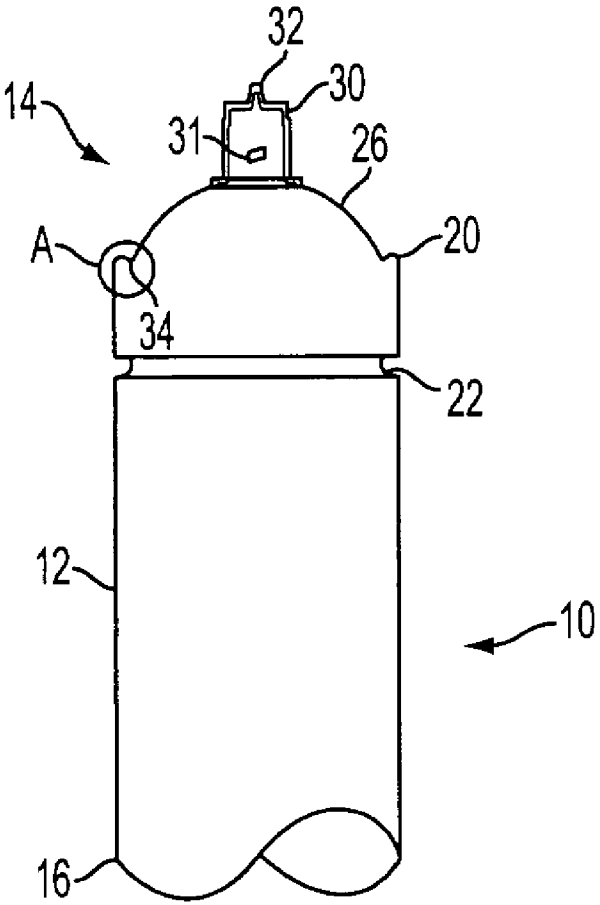
FIG. 5 depicts a front view of an intermediate article according to an embodiment of the present invention, where the article has an open end for being filled with a product.

FIG. 5 depicts a front view of an embodiment of an intermediate article/body 10 for use as a dispenser according to the invention, where the article 10 has an open end for being filled with a product. Similar intermediate articles are described in PCT/US01/45602 filed Nov. 2, 2001, U.S. Provisional Application No. 60/246,778 filed Nov. 8, 2000, and U.S. Provisional Application No. 60/318,155 filed Sept. 7, 2001, each of which is hereby incorporated in its entirety by reference. The article 10 has an open end 16 through which a dispenser prepared from the article 10 can be filled with a product. The article can have a one-piece construction and can be uniformly made of monolayer plastic material, such as LDPE, or a multilayer plastic material. The article 10 can be used to package a wide variety of liquid, viscous or free-flowing solid products including, for example, beverages, yogurt, sauces, pudding, lotions, soaps in liquid or gel form, and free-flowing powdered solids. The entire article 10 or the parts of it can be made by utilizing a suitable molding process, for example extrusion blow molding.

Turning first to the structural aspects of the article 10, it has a flexible sidewall 12 with opposite ends 14 and 16. A first end 14 is the dispensing end of the article 10. A neck finish 30 according to the present invention is integrally formed on the dispensing end 14. A second end 16, which is opposite from the dispensing end 14, is open and can be utilized to fill the article 10. The second end 16 can thereafter be heat sealed to from a straight line, planar seam.

The sidewall 12, as formed, is a radially surrounding sidewall of any type, including substantially tubular sidewall that forms a circular, oval or any other geometric shape in its cross-section. The sidewall 12 is flexible and enables the second end 16 to be flattened into a planar seam to seal the tube. The sidewall 12 adjacent the dispensing end 14 terminates in a circular standing ring 20 on which the dispenser can be freely stood with the seam on the second end 16 facing upwardly. A circumferential inset groove 22 can be formed in the sidewall 12 a short distance away from the standing ring 20 to reinforce the adjacent section of the sidewall 12. In addition, a label can be applied to the sidewall 12.

The first end 14 of the article 10 has a dome 26 extending from the standing ring 20 and closing the dispensing end 14. The dome can be of any geometrical shape, including spherical, oval and pyramidical shapes, that creates a convex section in an outwardly projecting position of the dome 26 and can be easily inverted into a corresponding concave section in an inwardly projecting position of the dome 26 by flipping the section about a hinged connection 34 between the standing ring 20 and the dome 26. (See FIGS. 6A–B.) Once the dome 26 is placed in either one of the inwardly and outwardly projecting positions, the dome 26 can retain its position absent an application of external forces to flip the dome 26 to the other position.

The flexible sidewall 12 and the first end 14 can be formed as one piece by using various molding techniques, including injection molding and blow molding techniques, without integrating separately manufactured parts. For example, when using extrusion blow molding techniques, a molten tube of thermoplastic material can be extruded relative to a pair of open blow mold halves. The blow mold halves can close about the molten tube and cooperate to provide a cavity into which the molten tube is blown to form the intermediate body/article 10. In using any of various molding techniques, the neck finish 30 with the protrusion 32 in the neck finish can be formed simultaneously with the molding of the sidewall 12 and the dome 26, and air for the blow molding process can be applied through the open end 16.

During the molding of the sidewall 12, labels can be bonded to the sidewall 12 by using the mold. Alternatively, labels can be attached after the molding. The dome 26 can first be molded in an outwardly projecting position and subsequently flipped into an inwardly projecting position before insertion of contents into the filling end 16.

After the molding step, the sidewall 12 can be trimmed along a cut line of the second end 16 of the intermediate article 10 to remove excess scrap material beyond the cut line. If the intermediate article 10 is to be filled with a food or drink product, a tamper evident covering can be bonded to the standing ring 20 to prevent contamination of the dispensing end 14 before filling the intermediate article 10.

Exemplary dimensions of the article 10 are as follows. A diameter of the article 10 around its sidewall 12 can be about 25 mm to about 150 mm, including 58.4 mm. A diameter of the article 10 around the circumferential inset groove 22 can be about 20 mm to about 100 mm, including 50.6 mm. The dome 26 can be about 8–35 mm in height, including 16.9 mm. The height of the sidewall 12 from the circumferential inset groove 22 to the standing ring 20 can be about 10–50 mm, including 22.0 mm. These dimensions are exemplary only and can be adjusted to any value as necessary for desired applications.

Figure 6A:
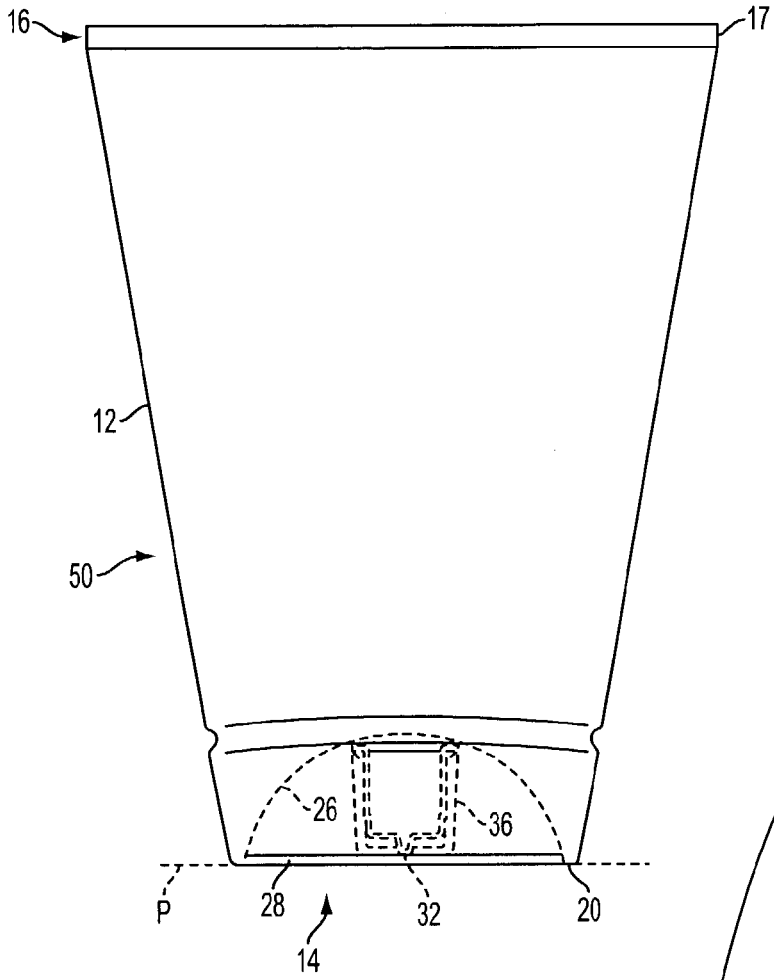
FIG. 6A depicts a perspective view of a dispenser with a sealed end, where the sealed end runs along the plane of the page.
Figure 6B:
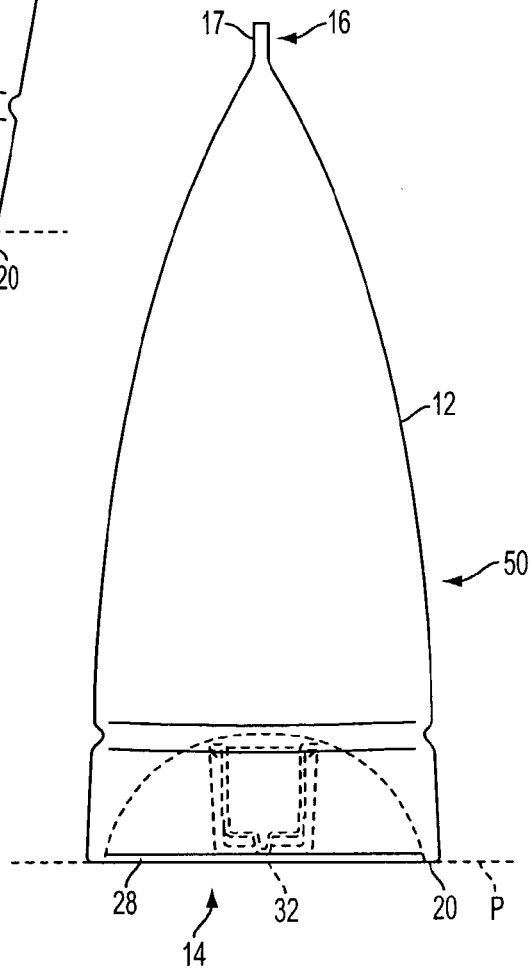
FIG. 6B depicts a perspective view of the dispenser disclosed in FIG. 6A, where the sealed end runs perpendicular to the plane of the page.

FIGS. 6A and 6B depict a dispenser 50, that can be prepared from an intermediate article 10 with the second end 16 flattened into a planar seam. The dome 26 is provided in an inwardly projecting position within the sidewall 12 and below an imaginary plane "P" extending through the standing ring 20. Thus, the dome 26 as illustrated in FIGS. 6A and 6B can be said to be in a storage position since the dome 26 does not interfere with the free standing of the dispenser 50 on the standing ring 20 and permits a tamper indicating covering 28 to be bonded to the standing ring 20 as best illustrated in FIGS. 6A and 6B. The covering 28 can be a foil or other sheet-like covering and can be utilized to prevent contamination or unrecognizable tampering of the first end 14 of the dispenser 50 before its removal by the purchasing consumer.

After the step of molding the intermediate article 10, the dispenser 50 is made by filling a product into the intermediate article through an open end and sealing the open end to from a closed planar seam 17.

When using the dispenser 50, the covering 28, if there is one, is first removed. The flexible sidewall 12 is grasped and squeezed resulting in the dome 26 flipping from an inwardly projecting position to an outwardly projecting position. This elevates the neck finish and the cap 36 to a readily accessible location. As is also shown in FIGS. 6A and 6B, when the cap 36 is in the closed position, the protrusion 32 of the neck finish is engaged in the opening of the cap to form a seal. From the outwardly projecting position of the dome 26, the cap 36 can be twisted/turned up to its open position. The ramp of the neck finish and the thread of the cap embraces against each other to inhibit the cap from being removed from the neck finish. In the open position, the protrusion 32 is removed from the opening of the cap so that an enclosed product can pass through the neck finish 30 into a hollow space between the cap and the neck finish, and out through the opening of the cap. A desired quantity of the contained product can be dispensed by squeezing the flexible sidewall 12. After extracting a desired quantity of the contained products, the cap 36 can be twisted down to the closed position and the dome 26 can be pushed back into the inwardly projecting position for using the standing ring or the dome 26 can be left in the outwardly projecting position.

Figure 7:
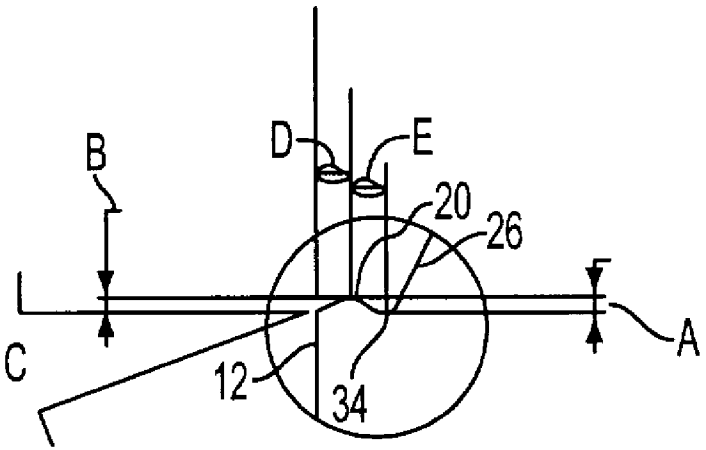
FIG. 7 depicts a close-up view of a hinged interconnection between a dome and a sidewall of the intermediate article in FIG. 5.

FIG. 7 depicts a close-up view of the hinged connection 34 between the standing ring 20 and the dome 26 to enable the dome 26 to flip from the inwardly projecting position as illustrated in FIGS. 6A and 6B to an outwardly projecting position as illustrated in FIG. 5. The hinged connection can be a live hinge having the following dimensions. The distance A from the peak of the standing ring 20 to the lowest point of the top surface of the hinged connection 34 can be about 0.4–2.0 mm in height, including 0.8 mm. The distance B from the peak of the standing ring 20 to the lowest point of the standing ring adjoining the sidewall 12 can be about 0.3–1.2 mm in height, including 0.6 mm. The angle C of the slope of the top surface of the standing ring 20 relative to a horizontal plane can be about 10°–40°, including 20°. The horizontal distance D from the peak of the top surface of the standing ring 20 to the lowest point of the top surface of the standing ring 20 adjoining the sidewall 12 can be about 0.7–3.5 mm in width, including 1.55 mm. The horizontal distance E from the peak of the top surface of the standing ring 20 to the lowest point of the top surface of the hinged connection 34 can be about 0.8–3.5 mm in width, including 1.75 mm.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed as new and desired to be protected by Letters Patent of the United States is:

1. An article comprising:

a radially surrounding sidewall having a first end, where the sidewall is molded as one piece; and the first end of the sidewall comprising:

a neck finish, the neck finish comprising:

an end wall at an end opposite the sidewall;

an opening in the end wall; and a protrusion in the end wall adapted for sealingly engaging a corresponding opening of a cap;

a dome between the sidewall and the neck finish; and a hinged interconnection between the dome and the sidewall.

2. The article of claim 1, wherein the neck finish further comprises a ramp adapted for slidingly engaging a thread of the cap to slide the cap up or down.

3. The article of claim 1, wherein the neck finish further comprises a neck ring adapted for engaging a cap ring of the cap when the cap is in a fully open position.

4. The article of claim 1, further comprising:

a contact surface formed on the neck finish adapted for sealingly engaging an inner surface of the cap.

5. The article of claim 1, wherein the sidewall has a second end, the second end being an open end.

6. A dispenser comprising:

a radially surrounding sidewall having a first end, where the sidewall is molded as one piece;

the first end of the sidewall comprising:

a neck finish, the neck finish comprising:

an end wall at an end opposite the sidewall;

an opening in the end wall; and a protrusion in the end wall;

a dome between the first sidewall and the neck finish; and a hinged interconnection between the dome and the sidewall; and a cap having an opening for sealingly engaging the protrusion of the neck finish.

7. The dispenser of claim 6, wherein the neck finish further comprises a ramp for slidingly engaging a thread of the cap to slide the cap up or down.

8. The dispenser of claim 6, wherein the neck finish further comprises a neck ring for engaging a cap ring of the cap when the cap is in a fully open position.

9. The dispenser of claim 6, wherein the cap comprises a top forming a radial ramp that radially ramps down from the opening to an end of the top at a sidewall of the cap.

10. The dispenser of claim 9, wherein the radial ramp is concave, convex or linear.

11. The dispenser of claim 6, further comprising:

a contact surface formed on the neck finish for sealingly engaging an inner surface of the cap.

12. A method of making an article comprising the steps of:

molding in a mold a body as one piece;

the body comprising:

a radially surrounding sidewall having a first end that comprises:

a neck finish, the neck finish comprising a protrusion in an end wall of the neck finish opposite the sidewall and the protrusion adapted for sealingly engaging a corresponding opening of a cap; and a dome between the first sidewall and the neck finish; and a hinged interconnection between the dome and the sidewall; and forming an opening in the end wall of the neck finish.

13. The method of claim 12, wherein the neck finish further comprises a ramp for slidingly engaging a thread of the cap to slide the cap up or down.

14. The method of claim 12, wherein the neck finish further comprises a neck ring for engaging a cap ring of the cap when the cap is in a fully open position.

15. The method of claim 12, further comprising the steps of:

trimming a second end of the sidewall of the body such that the second end is open.

16. A method of making an article comprising the steps of:

molding in a mold a body as one piece;

the body comprising:

a radially surrounding sidewall having a first end that comprises:

a neck finish, the neck finish comprising a protrusion adapted for sealingly engaging a corresponding opening of a cap; and a dome between the first sidewall and the neck finish; and a hinged interconnection between the dome and the sidewall; and forming an opening in the neck finish, wherein the neck finish further comprises an additional protrusion and the forming the opening comprises trimming the additional protrusion to create the opening of the neck finish.

17. The method of claim 12, wherein the forming an opening comprises reaming a hole in the neck finish.

18. The method of claim 12, further comprising the step of placing the cap on top of the neck finish.

19. The method of claim 12, further comprising the steps of:

filling the body with a product via a second end of the body, the second end being open initially; and sealing the second end with a seam to create a filled dispenser.

* * * * *

UNITED STATES PATENT AND TRADEMARK OFFICE

CERTIFICATE OF CORRECTION

PATENT NO. : 7,036,692 B2
APPLICATION NO. : 10/368524
DATED : May 2, 2006
INVENTOR(S) : Krohn It is certified that error appears in the above-identified patent and that said Letters Patent is hereby corrected as shown below:

On the Title page,

[*] Notice: Subject to any disclaimer, the term of this patent is extended or adjusted under 35 USC 154(b) by 43 days Delete the phrase "by 43 days" and insert -- by 163 days--

Signed and Sealed this

Tenth Day of April, 2007

JON W. DUDAS
*Director of the United States Patent and Trademark Office*